US007687152B2

(12) United States Patent
Ikematsu et al.

(10) Patent No.: US 7,687,152 B2
(45) Date of Patent: Mar. 30, 2010

(54) HIGH STRENGTH MOLTEN ZINC PLATED STEEL SHEET AND PROCESS OF PRODUCTION OF SAME

(75) Inventors: Yoichi Ikematsu, Futtsu (JP); Koki Tanaka, Futtsu (JP); Shunichi Hayashi, Futtsu (JP); Hideaki Sawada, Futtsu (JP); Akira Takahashi, Kimitsu (JP); Kazuhiko Honda, Kimitsu (JP); Masayoshi Suehiro, Futtsu (JP); Yoshihisa Takada, Kitakyushu (JP)

(73) Assignees: Nippon Steel Corporation, Tokyo (JP); USINOR, Puteaux (FR)

( * ) Notice: Subject to any disclaimer, the term of this patent is extended or adjusted under 35 U.S.C. 154(b) by 893 days.

(21) Appl. No.: 10/552,668

(22) PCT Filed: Mar. 30, 2004

(86) PCT No.: PCT/JP2004/004546

§ 371 (c)(1),
(2), (4) Date: Oct. 5, 2005

(87) PCT Pub. No.: WO2004/090187

PCT Pub. Date: Oct. 21, 2004

(65) Prior Publication Data

US 2006/0292391 A1 Dec. 28, 2006

(30) Foreign Application Priority Data

Apr. 10, 2003 (JP) ..... 2003-106210

(51) Int. Cl.

| | |
|---|---|
| ***B32B 15/18*** | (2006.01) |
| ***C22C 2/02*** | (2006.01) |
| ***C22C 2/06*** | (2006.01) |
| ***C21D 1/76*** | (2006.01) |

(52) U.S. Cl. ..... 428/659; 148/533; 428/939

(58) Field of Classification Search ..... None
See application file for complete search history.

(56) References Cited

U.S. PATENT DOCUMENTS

| | | | | |
|---|---|---|---|---|
| 6,398,884 | B1 * | 6/2002 | Kyono et al. | 148/537 |
| 6,913,658 | B2 * | 7/2005 | Delaunay et al. | 148/625 |
| 2001/0031377 | A1 | 10/2001 | Hashimoto et al. | |
| 2002/0160221 | A1 | 10/2002 | Takeda et al. | |
| 2006/0124907 | A1 * | 6/2006 | Takada et al. | 252/500 |
| 2006/0269776 | A1 * | 11/2006 | Tanaka et al. | 428/659 |

FOREIGN PATENT DOCUMENTS

EP 1 076 105 A1 2/2001

(Continued)

OTHER PUBLICATIONS

English machine translation of JP 10-204580 (Aug. 1998).*
English machine translation of JP 2000-290730 (Oct. 2000).*
English machine translation of JP 2001-323355 (Nov. 2001).*
English machine translation of JP 2002-173756 (Jun. 2002).*

*Primary Examiner*—John J Zimmerman
(74) *Attorney, Agent, or Firm*—Kenyon & Kenyon LLP

(57) ABSTRACT

A molten zinc plated steel sheet superior in plating bondability and provided with both strength and shapeability is provided and a method of producing this molten zinc plating steel sheet by a continuous zinc plating production system which enables production at a low cost without modification of the system or addition of steps is provided, said molten zinc plated steel sheet characterized by comprising, by wt %, a steel sheet including C: 0.05 to 0.40%, Si: 0.2 to 3.0%, and Mn: 0.1 to 2.5%, the balance comprised of Fe and unavoidable impurities, having on its surface a Zn plating layer containing Al: 0.01 to 1% and the balance of Zn and unavoidable impurities and containing inside the steel sheet within 2 μm from the interface of said plating layer and steel sheet oxide particles of at least one type of oxide selected from an Al oxide, Si oxide, Mn oxide, or complex oxide comprised of at least two of Al, Si, and Mn.

1 Claim, 1 Drawing Sheet

FOREIGN PATENT DOCUMENTS

| | | | |
|---|---|---|---|
| EP | 1 149 928 | A1 | 10/2001 |
| EP | 1 285 972 | A1 | 2/2003 |
| JP | 55-122865 | | 9/1980 |
| JP | 2-38549 | | 2/1990 |
| JP | 5-59429 | | 3/1993 |
| JP | 10 204580 | A | 8/1998 |
| JP | 2000 290730 | A | 10/2000 |
| JP | 2000-309824 | | 11/2000 |
| JP | 2001-279412 | * | 10/2001 |
| JP | 2001-323355 | | 11/2001 |
| JP | 2002-173756 | | 6/2002 |

* cited by examiner

HIGH STRENGTH MOLTEN ZINC PLATED STEEL SHEET AND PROCESS OF PRODUCTION OF SAME

TECHNICAL FIELD

The present invention relates to a high strength molten zinc plated steel sheet able to be utilized as steel sheet for an automobile and using as a material a high strength steel sheet containing Si and Mn and a process of production of the same.

BACKGROUND ART

In the auto industry, demand has been rising for steel sheet provided with the properties of both shapeability and high strength so as to achieve both lighter weight of the chassis to deal with environmental problems and safety in collisions.

To deal with these needs, Japanese Unexamined Patent Publication (Kokai) No. 5-59429 discloses steel sheet utilize the transformation-induced plasticity exhibiting a high ductility by the transformation of the residual austenite in the steel sheet structure to martensite at the time of shaping. This type of steel sheet for example forms a complex structure by the addition of for example C in 0.05 to 0.4 wt %, Si in 0.2 to 3.0 wt %, and Mn in 0.1 to 2.5 wt % in the steel and controlling the temperature pattern in the process of annealing in the two-phase region, then cooling and is characterized in that the desired properties can be brought out without the use of expensive alloy elements.

When zinc plating this steel sheet by a continuous molten zinc plating system, usually the surface of the steel sheet is degreased, the surface is cleaned, then, for the purpose of forming the above-mentioned structure, the sheet is heated in an nonoxidizing furnace to form an iron oxide layer of a thickness of 50 nm to 1 μm or so on the surface of the steel sheet, annealing the sheet in a reducing furnace to reduce the iron oxide layer, then dipping the sheet in a molten zinc plating bath to plate it with zinc.

Steel sheet, however, contains large amounts of easily oxidizing elements such as Si and Mn compared with the ordinary deep drawn cold-rolled steel sheet etc., so there is the problem that the surface of the steel sheet is easily formed with Si oxides, Mn oxides, or Si and Mn complex oxides in the heat treatment performed in the above series of steps. However, in industrial scale systems, it is difficult to reduce the oxygen potential of the atmosphere in the heating step to an extent where Si or Mn will not be oxidized, so formation of Si and Mn oxides at the surface of the steel sheet is substantially unavoidable. Further, if the surface of the steel sheet is formed with an Si oxide layer or Mn oxide layer, there are the problems that in the process of production of the molten zinc plated steel sheet, the wettability between the surface of the steel sheet and the molten plating remarkably deteriorates so the plating will not be deposited at parts and the surface of the steel surface will be exposed, that is, the phenomenon of "plating gaps" will arise, and the bondability of the plating will deteriorate. In particular, plating gaps are normally on the millimeter order in size, so its presence can be seen.

To deal with this problem, Japanese Unexamined Patent Publication (Kokai) No. 55-122865 discloses the method of forming a 40 to 1000 nm iron oxide layer on the surface of a steel sheet in a heat treatment step by a nonoxidizing furnace in a continuous molten zinc plating step so as to prevent outward diffusion of the Si or Mn in the reduction step, suppress the formation of the Si oxide layer, and improve the plating properties. With this method, however, if the reduction time is too long for the thickness of the iron oxide layer, Si will become dense at the surface of the steel sheet and an Si oxide layer will be formed, while if the reduction time is too short, iron oxide will remain on the surface of the steel sheet and the wettability will not be improved. Further, in recent continuous molten zinc plating systems, annealing systems using radiant type heating furnaces rather than nonoxidizing furnaces are becoming the mainstream. In such systems, there was the problem that the above method could not be used.

Japanese Unexamined Patent Publication (Kokai) No. 2-38549 proposes a method of pre-plating the surface of the steel sheet before annealing with the purpose of suppression outward diffusion of Si or Mn. However, with the pre-plating method, a plating system is required, so this cannot be employed when there is no space. Further, with steel sheet containing a large amount of Si or Mn, there was the problem that an increase in the amount of pre-plating is required and a drop in the productivity is invited.

Further, Japanese Unexamined Patent Publication (Kokai) No. 2000-309824 discloses as a method for preventing selective oxidation of the Si or Mn at the time of annealing the method of hot rolling the steel sheet, then heat treating it in the state with the black skin scale still attached in an atmosphere where reduction will substantially not occur and in a temperature range of 650 to 950° C. so as to form a sufficient internal oxide layer in the base iron surface layer. With this method, however, in addition to the conventional continuous molten zinc plating step, a heat treatment step for forming the internal oxide layer and a pickling treatment step become necessary, so there was the problem that a rise in production costs was invited.

DISCLOSURE OF INVENTION

In view of the above problems, the present invention has as its object the provision of an molten zinc plated steel sheet superior in strength and shapeability, free from plating gaps or other plating defects, and provided with good plating bondability. Further, the present invention has as its object the provision of a method of producing this molten zinc plating steel sheet at a low cost without modification of the system or addition of steps to a conventional continuous molten zinc plating production system.

To solve the above problems, the inventors engaged in intensive studies and as a result newly discovered that, in the recrystallization annealing step before molten plating, by forming inside the surface layer of the steel sheet oxide particles of at least one type selected from an Al oxide, Si oxide, Mn oxide, or complex oxide of Al, Si, and Mn alone or in combination and suppressing the amount of production of the external oxide layer produced on the surface of the steel sheet, the wettability or bondability of the surface of the steel sheet with the plating is improved and enabled the production of molten zinc plated steel sheet with a good plateability and superior in strength and shapeability.

Further, the inventors discovered that the above molten zinc plated steel sheet can be obtained by adjusting the ratio $PH_2O/PH_2$ of the steam partial pressure and hydrogen partial pressure of the atmosphere in the reducing furnace in the recrystallization annealing step of a continuous molten zinc plating system to $$1.4\times10^{-10}T^2-1.0\times10^{-7}T+5.0\times10^{-4}\leqq PH_2O/PH_2\leqq 6.4\times10^{-7}T^2+1.7\times10^{-4}T-0.1$$

with respect to the heating temperature T (° C.), forming oxide particles at a region from the surface of the steel sheet to a depth of 2 μm, then performing molten zinc plating treatment.

That is, the present invention has the following as its gist:

(1) A high strength molten zinc plated steel sheet characterized by comprising a steel sheet including, by wt %, C: 0.05 to 0.40%, Si: 0.2 to 3.0%, and Mn: 0.1 to 2.5% and further including at least one or two or more types of:

P: 0.001 to 0.05%,

S: 0.001 to 0.05%,

Al: 0.01% to 2%,

B: 0.0005% to less than 0.01%,

Ti: 0.01% to less than 0.1%,

V: 0.01% to less than 0.3%,

Cr: 0.01% to less than 1%,

Nb: 0.01% to less than 0.1%,

Ni: 0.01% to less than 2.0%,

Cu: 0.01% to less than 2.0%,

Co: 0.01% to less than 2.0%,

Mo: 0.01% to less than 2.0%, with the balance comprised of Fe and unavoidable impurities, having on its surface a Zn plating layer containing Al in a concentration of 0.01 to 1 wt % and the balance of Zn and unavoidable impurities and containing inside the steel sheet within 2 μm from the interface of said steel sheet oxide particles of at least one type of oxide selected from an Al oxide, Si oxide, Mn oxide, or complex oxide comprised of at least two of Al, Si, and Mn.

(2) A high strength molten zinc plated steel sheet as set forth in (1), characterized in that said oxide particles are comprised of at least one of silicon oxide, manganese oxide, aluminum oxide, aluminum silicate, manganese silicate, manganese aluminum oxide, and manganese aluminum silicate.

(3) A high strength molten zinc plated steel sheet as set forth in (1) or (2), characterized in that an average diameter of the particle size of said oxide is 0.001 to 1 μm.

(4) A process of production of a high strength molten zinc plated steel sheet comprised of the ingredients described in (1) by a continuous molten zinc plating system, said process of production of a high strength molten zinc plated steel sheet characterized by making a heating temperature T at a recrystallization annealing step in a reducing furnace of said system 650° C. to 900° C., passing the steel sheet through an atmosphere where a ratio $PH_2O/PH_2$ of the steam partial pressure $PH_2O$ and hydrogen partial pressure $PH_2$ of the atmosphere of said reducing furnace is $1.4\times10^{-10}\times T^2-1.0\times10^{-7}\times T+5.0\times10^{-4}\leqq PH_2O/PH_2\leqq 6.4\times10^{-7}\times T^2+1.7\times10^{-4}\times T-0.1$, forming an internal oxide of (1) at a region from the surface of the steel sheet to a depth of 2.0 μm, then performing molten zinc plating treatment.

(5) A process of production of a high strength molten zinc plated steel sheet as set forth in (4), characterized in that said oxide particles are comprised of at least one of silicon oxide, manganese oxide, aluminum oxide, aluminum silicate, manganese silicate, manganese aluminum oxide, and manganese aluminum silicate.

(6) A process of production of a high strength molten zinc plated steel sheet as set forth in (4), characterized in that an average diameter of the particle size of said oxide is 0.001 to 1 μm.

BEST MODE FOR CARRYING OUT THE INVENTION

Figure 1:
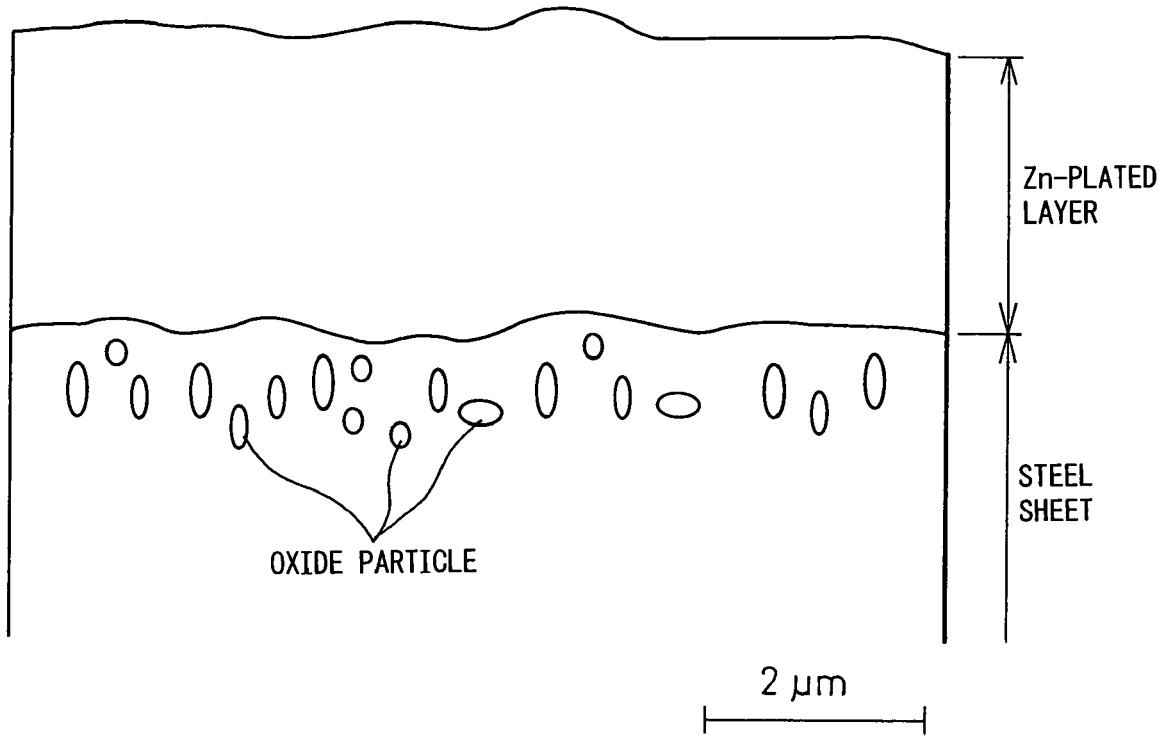
FIG. 1 is a schematic view of an example of the cross-section of a molten zinc plated steel sheet of the present invention.

The molten zinc plated steel sheet of the present invention is characterized by being provided with both a superior press formability and strength and by being superior in plating bonding free from plating defects such as plating gaps.

To impart this characterizing feature, first, to secure the ductility and strength of the steel sheet itself, the ingredients of the steel sheet are made, by wt %, C: 0.05 to 0.40%, Si: 0.2 to 3.0%, Mn: 0.1 to 2.5%, and the balance of Fe and unavoidable impurities.

The reasons for addition of the additive elements to the steel sheet base material of the molten zinc plated steel sheet used in the present invention will be explained below.

C is an element added for stabilizing the austenite phase of the steel sheet. If the amount of addition is less than 0.05%, its effect cannot be expected. Further, if over 0.40%, the weldability is degraded and there are other detrimental effects in actual use of the molten zinc plated steel sheet of the present invention, so the amount of addition of C was made 0.05% to 0.4%.

Si is an element added for enabling the stable presence of an austenite phase even at room temperature due to the action of increasing the concentration of C in the austenite phase. Further, Si has the action of forming an internal oxide and finely dispersing inside the surface layer of the steel sheet in the recrystallization annealing step to improve the wettability of the steel sheet interface at the time of molten zinc plating and improve the bondability of the plating layer in the final product. If the amount added is less than 0.2%, its effect cannot be expected, while if over 3.0%, the internal oxide film is formed thickly—inviting peeling of the plating, so the amount added of Si is made 0.2% to 3.0%.

Mn is added for preventing the austenite phase from transforming to pearlite in the heat treatment step. Further, Mn, in the same way as Si, has the action of forming an internal oxide and finely dispersing inside the surface layer of the steel sheet in the recrystallization annealing step to improve the wettability of the steel sheet interface at the time of molten zinc plating and improve the bondability of the plating layer in the final product. If the amount added is less than 0.1%, these effects are nonexistent, while if over 2.5%, the welded parts break and there are other detrimental effects in actual use of the molten zinc plated steel sheet of the present invention, so the concentration of the Mn added was made 0.1% to 2.5%.

The steel sheet base material of the present invention basically contains the above elements, but the added elements are not limited to just these elements. It is also possible to add elements already known to have action to improve the properties of the steel sheet.

P is added in accordance with the required level of strength as an element raising the strength of the steel sheet. If the amount added is large, it will segregate at the grain boundaries and cause the local ductility to deteriorate, so the upper limit is made 0.05%. The lower limit is made 0.001% because reduction over this would lead to an increase in the cost at the time of refining at the steel-making stage.

S is an element causing deterioration of the local ductility and weldability by the production of MnS and is an element which is preferably present in the steel, so the upper limit is made 0.05%. The lower limit is made 0.001% due to the increase in cost at the time of refining in the steel-making stage in the same way as P.

Al is an element effective for improving the press formability of the steel sheet. Further, Al has the action of forming an internal oxide and finely dispersing inside the surface layer of the steel sheet in the recrystallization annealing step in the same way as the above Si and Mn to improve the wettability of the steel sheet interface at the time of molten zinc plating and improve the bondability of the plating layer in the final product. Therefore, Al is preferably at least 0.01%, but excessive addition of Al would invite degradation of the plating properties and an increase in inclusions, so the amount added of Al is preferably not more than 2%.

Further, for example, it is also possible to add, among B, Ti, V, Cr, and Nb having the effect of improvement of quenching, B in an amount of 0.0005% to less than 0.01%, Ti of 0.01% to less than 0.1%, V of 0.01% to less than 0.3%, Cr of 0.01% to less than 1%, and Nb of 0.01% to less than 0.1%. These elements are added with the expectation of improving the quenchability of the steel sheet, so if less than the above added concentrations, no effect of improvement of the quenchability can be expected. Further, inclusion in an amount over the upper limit of the above added concentration is possible, but the effect becomes saturated and an effect of improvement of quenchability commensurate with the cost can no longer be expected.

Further, for example, it is also possible to add Ni, Cu, Co, Mo, and other elements having the effect of improvement of strength in amounts of 0.01% to less than 2.0%. These elements are added in the expectation of the effect of improvement of strength. If less than the prescribed concentration, no effect of improvement of the strength can be expected. On the other hand, an excessive content of Ni, Cu, Co, or Mo leads to excessive strength or a rise in the alloy costs. Further, the sheet may also contain P, S, N, and other generally unavoidable elements.

The zinc plated steel sheet of the present invention is preferably made a steel sheet structure including at least 2% by vol % of an austenite phase in the ferrite phase to impart superior processability and strength due to processing-induced transformation at room temperature. If the vol % of the austenite phase exceeds 20%, if shaped extremely strictly, there is a higher possibility of the existence of a large amount of martensite in the press formed state. This sometimes causes a problem in the secondary processing or impact properties. Therefore, the vol % of austenite is preferably not more than 20%. Further, as another structure, it is also possible to contain hard bainite in a vol % of not more than 10%. The bainite transformation effectively concentrates the carbon in the austenite in the microstructure and stabilizes the austenite, but if over 10% in vol %, the necessary amount of bainite can no longer be secured.

The vol % in the microstructure can be found by observation of the microstructure by an optical microscope or scanning electron microscope (SEM) for ferrite, while the vol % of austenite can be found by evaluating the evaluating the integrated strengths of the diffraction peaks corresponding to ferrite and austenite by X-ray diffraction using an Mo tube. Further, the bainite can be found from the values of the vol % of the ferrite and austenite.

The composition of the plating layer of the molten zinc plated steel sheet according to the present invention is made, by wt %, Al of 0.01 to 1% and a balance of Zn and unavoidable impurities.

The reason is that with normal molten zinc plating with less than 0.01% of Al, at the time of plating, a Zn—Fe alloying reaction occurs, a brittle alloy layer forms at the plating/steel sheet interface, and the plating bondability deteriorates. If over 1%, the growth of the Fe—Al alloy layer becomes remarkable and the plating bondability is inhibited. Further, the basis weight of the plating is not particularly limited, but it is preferably at least 10 g/m$^2$ from the viewpoint of the corrosion resistance and not more than 150 g/m$^2$ from the viewpoint of the processability.

Next, the structure of a molten zinc plated steel sheet of the present invention will be explained.

FIG. 1 is a schematic view of the cross-section of a molten zinc plated steel sheet of an example of the present invention. The molten zinc plated steel sheet of the present invention is characterized by containing inside the steel sheet within 2 μm from the interface of the plating layer and steel sheet oxide particles comprised of at least one type of oxide of Al oxide, Si oxide, Mn oxide, or a complex oxide comprised of at least two of Al, Si, and Mn alone or in combination. In the molten zinc plated steel sheet of the present invention, in the prior method, the oxides which had been the cause of inhibiting bondability of the plating layer due to formation at the surface of the steel sheet are formed finely dispersed inside the steel sheet within 2 μm from the interface of the steel sheet, so the wettability of the surface of the steel sheet at the time of molten zinc plating is improved and the plating layer and steel layer directly react, whereby the bondability of the plating layer at the final product is improved.

Note that the oxide particles are silicon oxide, manganese oxide, manganese silicate, aluminum oxide, aluminum silicate, manganese aluminum oxide, and manganese aluminum silicate.

The size of the oxide particles present inside the steel sheet near the plating layer/steel sheet interface is preferably not more than 1 μm. The reason is that if the average diameter of the oxide particles is more than 1 μm, at the time of processing the molten zinc plated steel sheet, the oxide particles easily become starting points of fracture and the corrosion resistance of the processed parts is degraded, that is, detrimental effects easily occur when putting the molten zinc plated steel sheet into practical use.

Note that the "average diameter" of the oxide particles referred to in the present invention indicates the average equivalent circular diameter of the oxide particles detected by observation of the cross section of the steel sheet. The shape of the oxide particles may be spherical, plate-like, or conical.

As the method of measuring the average diameter of the oxide particles, the method may be mentioned of polishing the cross section of the molten zinc plated steel sheet or using a focused ion beam processing system to finely process the sheet to expose the cross section and thereby prepare a sample, then analyzing it by observation by a scanning electron microscope, plane analysis by X-ray microanalysis, or plane analysis by Auger electron spectroscopy. Further, it is possible to process the cross section of the steel sheet to a thin piece so as to include the plating layer, then observe this by a transmission type electron microscope. In the present invention, the image data obtained by these analysis methods is analyzed to calculate the equivalent circular diameter of the oxide particles. The average value should be not more than 1 μm. Particles of more than 1 μm may also be included in the observed region.

Further, the content of the oxide particles in the steel sheet is not particularly limited, but preferably the steel sheet contains the particles in a density of not more than $1\times10^{11}$ particles/cm$^2$. Excess oxide particles of over $1\times10^{11}$ particles/cm$^2$ become a cause of peeling of the plating layer.

Next, the process of production of the molten zinc plated steel sheet of the present invention will be explained.

In the present invention, a continuous molten zinc plating system is used for molten zinc plating of the above high strength steel sheet.

In the process of production of a molten zinc plated steel sheet of the present invention, the heating pattern is set so that the steel sheet becomes the above desired structure in the recrystallization annealing step of the continuous molten zinc plating system. That is, a reducing furnace is used to anneal steel sheet in a two-phase coexisting region of 650 to 900° C. for 30 seconds to 10 minutes.

The atmosphere in the reducing furnace is made nitrogen gas including hydrogen gas in a range of 1 to 70 wt %. Steam is introduced into the furnace to adjust the ratio ($PH_2O/PH_2$) of the steam partial pressure and hydrogen partial pressure of the atmosphere. In the present invention, the ratio $PH_2O/PH_2$ of the steam partial pressure and hydrogen partial pressure of the atmosphere of the reducing furnace is adjusted to $$1.4\times10^{-10}T^2-1.0\times10^{-7}T+5.0\times10^{-4}\leqq PH_2O/PH_2\leqq 6.4\times10^{-7}T^2+1.7\times10^{-4}T-0.1$$

with respect to the heating temperature T (° C.) in the recrystallization annealing step.

The reason for limiting the ratio $PH_2O/PH_2$ of the steam partial pressure and hydrogen partial pressure of the atmosphere of the reducing furnace to the above range is as follows. That is, in the present invention, since the steel sheet contains Si in an amount of at least 0.2 wt % and Mn in at least 0.1 wt %, if $PH_2O/PH_2$ is less than $1.4\times10^{-10}T^2-1.0\times10^{-7}T+5.0\times10^{-4}$, an external oxide film is formed on the surface of the steel sheet and poor bonding of the plating occurs. Further, in the present invention, the Si added to the steel sheet is not more than 3.0 wt % and Mn not more than 2.5 wt %, so if $PH_2O/PH_2$ exceeds $6.4\times10^{-7}T^2+1.7\times10^{-4}T-0.1$, fayalite and other Fe oxides are formed and plating gaps arise. By annealing by the above method, it is possible to form in a region from the surface of the steel sheet to a depth of 2 μm a structure having least one type of oxide particles selected from Al oxide, Si oxide, Mn oxide, or a complex oxide comprised of at least two of Al, Si, and Mn alone or in combination.

Next, in the plating step, the steel sheet is cooled at a cooling rate of 2 to 200° C. per second to a temperature range of 350 to 500° C., held there for 5 seconds to 20 minutes, then plated by being dipped in a molten zinc plating bath comprised of, by wt %, Al in an amount of 0.01 to 1% with the balance of Zn and unavoidable impurities. The temperature and dipping time of the plating bath at this time are not particularly limited. Further, the example of the heating and cooling patterns in the plating step does not limit the present invention.

Further, when forming the plating layer structure of the present case, sometimes part of the oxides inside the surface layer of the steel sheet migrate to the plating layer, but this is allowable so long as a trace amount not affecting the effect of the present case.

After the molten zinc plating, the steel sheet is cooled at a cooling rate of at least 5° C./sec to below 250° C. Due to this, a steel sheet structure suppressed in decomposition of the austenite phase and including the desired austenite phase is obtained.

Below, the present invention will be explained in detail by examples, but the present invention is not limited to these examples.

The test steel sheets shown in Table 1 were treated for recrystallization annealing and plating by a continuous molten zinc plating system in accordance with the conditions shown in Table 2. The molten zinc plating bath was adjusted to a bath temperature of 460° C. and a bath composition of Al of 0.1 wt % and the balance of zn and unavoidable impurities. The atmosphere of the reducing furnace was adjusted to a ratio of the steam partial pressure and hydrogen partial pressure ($PH_2O/PH_2$) by introducing steam into $N_2$ gas to which $H_2$ gas is added in an amount of 10 wt % to adjust the amount of introduction of steam. The annealing temperature and $PH_2O/PH_2$ were set to the values shown in Table 2, each of the steel sheets shown in Table 1 was recrystallization annealed, then was dipped in the plating bath. The amount of plating was adjusted to 60 g/m$^2$ by nitrogen gas wiping.

TABLE 1

| Test material | Composition (wt %) | | | | | | | | | | |
|---|---|---|---|---|---|---|---|---|---|---|---|
| code | C | Si | Mn | Al | P | S | Ti | Nb | Ni | Cu | Remarks |
| NA | 0.11 | 1.21 | 1.29 | | 0.004 | 0.004 | | | | | Invention |
| A | 0.098 | 0.23 | 1.59 | 0.09 | 0.004 | 0.006 | 0.02 | | 0.6 | 0.2 | Invention |
| B | 0.112 | 0.21 | 1.55 | 0.68 | 0.005 | 0.007 | 0.02 | 0.01 | 0.01 | 0.2 | Invention |
| C | 0.102 | 1.52 | 1.49 | 0.04 | 0.005 | 0.005 | | | 0.002 | | Invention |
| D | 0.061 | 1.41 | 2.28 | 0.29 | 0.004 | 0.006 | | | | | Invention |
| E | 0.099 | 1.51 | 0.55 | 0.21 | 0.005 | 0.004 | | | | | Invention |
| F | 0.115 | 0.11 | 1.44 | 0.47 | 0.006 | 0.003 | | | | | Comp. ex. |

TABLE 2

| Processing condition no. | Annealing temp. (° C.) | $PH_2O/PH_2$ | Remarks |
|---|---|---|---|
| 1 | 705 | 0.01 | Invention ex. |
| 2 | 705 | 0.0004 | Comp. ex. |
| 3 | 802 | 0.01 | Invention ex. |
| 4 | 802 | 0.03 | Invention ex. |
| 5 | 802 | 0.0004 | Comp. ex. |
| 6 | 802 | 0.0003 | Comp. ex. |
| 7 | 900 | 0.02 | Invention ex. |
| 8 | 902 | 0.0004 | Comp. ex. |

The strength of the steel sheets was evaluated by JIS Z 2201. A tensile strength of 490 MPa or more was judged as passing. The elongation of the steel sheets was evaluated by obtaining a JIS No. 5 tensile test piece and performing an ordinary temperature tensile test at a gauge thickness of 50 mm and a tensile rate of 10 mm/min. A sheet exhibiting an elongation of 30% or more was judged as passing.

The oxide particles inside the steel sheet within 2 μm from the interface of the plating layer and steel sheet were evaluated by polishing the cross section of the plated steel sheet to expose it and observing it and capturing an image of the oxide particles by an SEM. The image captured by the SEM was digitalized and the parts with a brightness corresponding to the oxides were extracted by image analysis to prepare a digital image. The prepared digital image was cleared of noise, then the equivalent circular diameters of the particles were measured and the average value of the equivalent circular diameters was found for the particles as a whole detected in the observed field.

The plating gaps were evaluated by visually observing the appearance of the steel sheet after zinc plating and deeming as passing steel sheet where presence of plating gaps could not be recognized. Further, the bondability of the plating was evaluated by investigating the powdering. Specifically, this was by bending a steel sheet by 180 degrees, bonding cellophane tape at the bent part, peeling it off, measuring the peeling width of the plating layer stuck to the tape, and deeming as passing steel sheets with a peeling width of over 3 mm.

Table 3 shows the results of the evaluation. From Table 3, the test materials subjected to the molten zinc plating which passed in strength, elongation, plating bondability, and appearance were all examples of the present invention. The comparative examples either passed in the strength and elongation, but failed in peeling bondability or passed in strength and peeling bondability, but failed in elongation.

TABLE 3

| Steel sheet code | Treatment condition no. | Average size of oxide particles (μm) | Type of oxide | Strength | Elongation | Plating gaps | Bondability | Remarks |
|---|---|---|---|---|---|---|---|---|
| NA | 3 | 0.21 | SO, MO, MSO | P | P | P | P | Invention ex. |
| NA | 4 | 0.27 | SO, MO, MSO | P | P | P | P | Invention ex. |
| NA | 5 | ND | — | P | P | F | F | Comp. ex. |
| NA | 7 | 0.41 | SO, MO, MSO | P | P | P | P | Invention ex. |
| NA | 8 | ND | — | P | P | F | F | Comp. Ex. |
| A | 3 | 0.09 | SO, MO, MSO | P | P | P | P | Invention ex. |
| A | 4 | 0.32 | SO, MO, MSO | P | P | P | P | Invention ex. |
| A | 5 | ND | — | P | P | F | F | Comp. Ex. |
| A | 7 | 0.41 | SO, MO, MSO | P | P | P | P | Invention ex. |
| A | 8 | ND | — | P | P | F | F | Comp. Ex. |
| B | 1 | 0.22 | SO, MO, AO, ASO, MSO, MAO, MASO | P | P | P | P | Invention ex. |
| B | 2 | ND | — | P | P | F | F | Comp. Ex. |
| B | 3 | 0.1 | SO, MO, AO, ASO, MSO, MAO, MASO | P | P | P | P | Invention ex. |
| B | 4 | 0.13 | SO, MO, AO, ASO, MSO, MAO, MASO | P | P | P | P | Invention ex. |
| B | 5 | ND | — | P | P | F | F | Comp. Ex. |
| B | 6 | ND | — | P | P | F | F | Comp. Ex. |
| C | 1 | 0.38 | SO, MO, MSO | P | P | P | P | Invention ex. |
| C | 2 | ND | — | P | P | F | F | Comp. Ex. |
| C | 3 | 0.39 | SO, MO, MSO | P | P | P | P | Invention ex. |
| C | 4 | 0.35 | SO, MO, MSO | P | P | P | P | Invention ex. |
| C | 5 | ND | — | P | P | F | F | Comp. Ex. |
| C | 6 | ND | — | P | P | F | F | Comp. Ex. |
| C | 7 | 0.27 | SO, MO, MSO | P | P | P | P | Invention ex. |
| C | 8 | ND | — | P | P | F | F | Comp. Ex. |
| D | 3 | 0.49 | SO, MO, AO, ASO, MSO, MAO, MASO | P | P | P | P | Invention ex. |
| D | 4 | 0.42 | SO, MO, AO, ASO, MSO, MAO, MASO | P | P | P | P | Invention ex. |
| D | 5 | ND | — | P | P | F | F | Comp. Ex. |
| D | 6 | ND | — | P | P | F | F | Comp. Ex. |
| E | 3 | 0.31 | SO, MO, AO, ASO, MSO, MAO, MASO | P | P | P | P | Invention ex. |
| E | 4 | 0.25 | SO, MO, AO, ASO, MSO, MAO, MASO | P | P | P | P | Invention ex. |
| E | 5 | ND | — | P | P | F | F | Comp. Ex. |
| E | 6 | ND | — | P | P | F | F | Comp. Ex. |
| F | 1 | 0.12 | MO, AO, ASO, MSO, MAO, MASO | P | F | P | P | Comp. Ex. |
| F | 5 | ND | — | P | F | F | F | Comp. Ex. |

* P: pass, F: fail, ND: not detected.
* Types of oxides: silicon oxide: SO, manganese oxide: MO, aluminum oxide: AO, aluminum silicate: ASO, manganese silicate: MSO, manganese aluminum oxide: MAO, manganese aluminum silicate: MASO

INDUSTRIAL APPLICABILITY

The molten zinc plated steel sheet of the present invention is a steel sheet has the oxides containing Si and Mn inhibiting the plateability formed inside the steel sheet which is superior in plating bondability and provided with both strength and shapeability. According to the process of production of the present invention, it is possible to produce this at a low cost by just changing the operating conditions of an existing continuous zinc plating production system.

The invention claimed is:

1. A high strength molten zinc plated steel sheet characterized by comprising a steel sheet including, by wt %, C: 0.05 to 0.40%, Si: 0.2 to 3.0%, Mn: 0.1 to 2.5%, and including at least one or two or more types of:

P: 0.001 to 0.05%,

S: 0.001 to 0.05%,

Al: 0.0 1% to 2%,

B: 0.0005% to less than 0.01%,

Ti: 0.01 to less than 0.1%,

V: 0.01 to less than 0.3%,

Cr: 0.01% to less than 1%,

Nb: 0.01% to less than 0.1%,

Ni: 0.01% to less than 2.0%,

Cu: 0.01% to less than 2.0%,

Co: 0.01% to less than 2.0%,

Mo: 0.01% to less than 2.0%, with a balance of Fe and unavoidable impurities, further containing a steel sheet structure including at least 2% to 20% by vol % of an austenite phase in a ferrite phase, having on its surface a Zn plating layer containing Al in a concentration of 0.01 to 1 wt % and a balance of Zn and unavoidable impurities, and containing inside the steel sheet within 2.0 μm from the interface of the plating layer and the steel sheet at least one type of internal oxide particles selected from Al oxide, Si oxide, Mn oxide, or a complex oxide composed of at least two of Al, Si, and Mn, wherein the oxide particle has an average diameter of 0.001 to 1 μm in a density of not more than $1\times10^{11}$ particles/$cm^2$, wherein said zinc plated steel sheet is produced by the steps comprising;

heating the steel sheet without forming an external oxide layer and Fe oxides on the surface of the steel sheet by means of a radiant tube heating system in a continuous molten zinc plating step, heating the steel sheet at a heating a temperature T of 650° C. to 900° C. in the dual phase region during recrystallization annealing for 30 sec. to 10 min., reducing the steel sheet through a reducing atmosphere where a ratio $PH_2O/PH_2$ of the steam partial pressure $PH_2O$ and hydrogen partial pressure $PH_2$ of the reducing atmosphere is $1.4\times10^{-10}\times T^2-1.0\times10^{-7}\times T+5.0\times10^{-4}\leqq PH_2O/PH_2\leqq 6.4\times10^{-7}\times T^2+1.7\times10^{-4}\times T-0.1$, forming inside the steel sheet wherein 2.0 μm from the interface of the plating layer and the steel sheet at least one type of internal oxide particles selected from Al, oxide, Si oxide, Mn oxide, or a complex oxide composed of at least two of Al, Si and Mn, wherein the oxide particle has an average diameter of 0.001 to 1 μm in a density of not more than $1\times10^{11}$ particles/$cm^2$, cooling the steel sheet to a temperature range of 350 to 500° C., and maintaining the cooled steel sheet for 5 sec. to 20 min., performing molten zinc plating treatment in a molten zinc bath, containing Al:0.01to 1 wt % and a remainder of Zn, having a temperature of 450° C. to 500° C., then cooling the zinc plated steel sheet to a temperature of below 250° C. with a cooling rate of more than 5° C./sec.

* * * * *